US006033318A

United States Patent [19]

Drajan, Jr. et al.

[11] Patent Number: 6,033,318

[45] Date of Patent: Mar. 7, 2000

[54] GOLF DRIVER HEAD CONSTRUCTION

[76] Inventors: Cornell Drajan, Jr., Rte. 1 Box 162-A, Hendersonville, N.C. 28792; Allan Thomas Catellier, 3912 Alderwood Dr., Kingsport, Tenn. 37873

[21] Appl. No.: 09/161,650

[22] Filed: Sep. 28, 1998

[51] Int. Cl.[7] ..... A63B 53/02; A63B 53/04; A63B 53/08

[52] U.S. Cl. ..... 473/309; 473/310; 473/334; 473/345; 473/349

[58] Field of Search ..... 473/305–315, 473/324–350

[56] References Cited

U.S. PATENT DOCUMENTS

| | | |
|---|---|---|
| 581,331 | 4/1897 | Brewster . |
| 1,551,563 | 9/1925 | Heller . |
| 2,064,943 | 12/1936 | Reach . |
| 2,203,893 | 6/1940 | Chapman . |
| 4,085,934 | 4/1978 | Churchward . |
| 5,154,424 | 10/1992 | Lo . |
| 5,251,901 | 10/1993 | Solheim et al. . |
| 5,335,908 | 8/1994 | Bamber . |
| 5,439,218 | 8/1995 | Gondeck . |
| 5,452,890 | 9/1995 | Bingman . |
| 5,545,094 | 8/1996 | Hsu . |
| 5,632,692 | 5/1997 | Lebovici . |
| 5,632,695 | 5/1997 | Hlinka et al. . |
| 5,720,674 | 2/1998 | Galy . |
| 5,855,526 | 1/1999 | Honma . |
| 5,931,742 | 8/1999 | Nishimura . |

*Primary Examiner*—Sebastiano Passaniti
*Attorney, Agent, or Firm*—Shoemaker and Mattare, Ltd

[57] ABSTRACT

A golf driver head has a double-walled hosel contained wholly within the head. The hosel includes an inner tube into which a club shaft may be inserted, and an outer tube situated around the inner tube and having a clearance defining an annular space between the inner tube and the outer tube. An annular bridge extends across the annular space, interconnecting the inner tube and the outer tube, and the space between the inner and outer tubes is filled with an elastomeric damping material.

7 Claims, 4 Drawing Sheets

GOLF DRIVER HEAD CONSTRUCTION

BACKGROUND OF THE INVENTION

This invention relates to a golf driver head construction.

Modem drivers have strong, light, low-hysteresis shafts connected to the club head at a hosel, which protrudes upward from the club head. The hosel is a highly stressed potential failure site. It also contributes to aerodynamic drag on the head when the club is swung.

The hosel must provide a fairly rigid connection between the head of the club and shaft, so that the head does not pitch downward unduly as the ball is struck, changing the loft angle. With conventional clubs, the hosel is well above the center of gravity of the club head, and the center of impact when the ball is struck. Impact forces therefore create substantial bending moments at the hosel.

An additional consideration is that the center of gravity of ordinary club heads cannot be repositioned easily, or at all. Altering the weighting of a club is ordinarily a matter for the shop. It would be advantageous to permit golfers to reweight their own clubs without any tools, other than a screwdriver.

SUMMARY OF THE INVENTION

An object of the invention is to provide a recessed hosel which does not protrude from the club and thus does not contribute to aerodynamic drag.

Another object is to provide a hosel which minimizes pitching of the club face during ball impact.

A third object of the invention is to damp club head vibrations at the hosel.

Yet another object is to make it easy for the seller or purchaser of a golf driver to alter the center of gravity of the club.

These and other objects are attained by a golf driver head having a recessed hosel. The hosel includes an inner tube into which a club shaft may be inserted, and an outer tube situated around the inner tube and having a clearance defining an annular space between the inner tube and the outer tube. An annular bridge extends across the annular space, interconnecting the inner tube and the outer tube, and the space between the inner and outer tubes is filled with an elastomeric damping material. An assortment of different sole plates are provided so that one can alter the center of gravity of the driver head merely by changing sole plates.

BRIEF DESCRIPTION OF THE DRAWINGS

In the accompanying drawings.

DESCRIPTION OF THE PREFERRED EMBODIMENT

Figure 1:
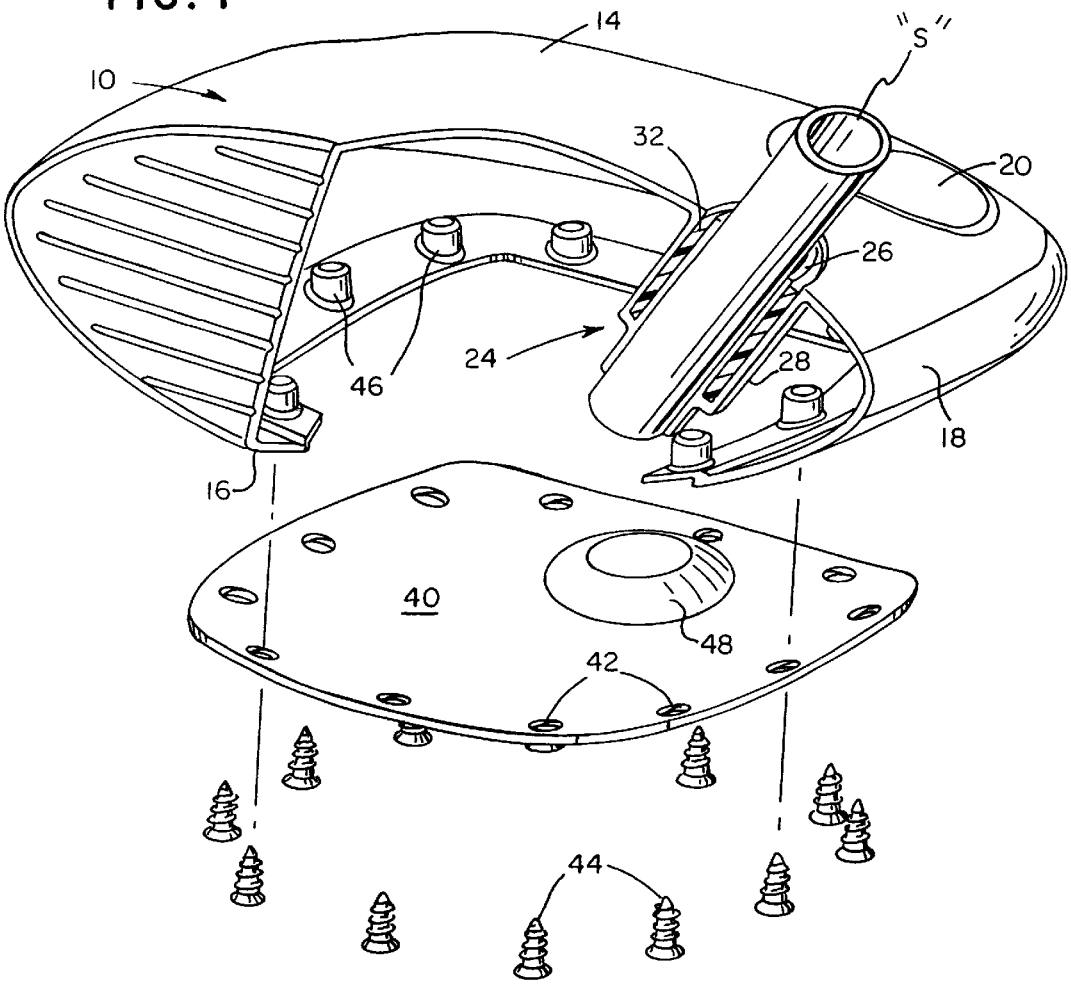
FIG. 1 is a perspective view of a golf driver head construction embodying the invention, partially broken away to show interior detail.

A golf driver head embodying the invention is hollow, comprising a metal shell 10 having a grooved driving face 12, a top surface 14, and a bottom surface 16. A portion of FIG. 1 is broken away, showing the interior of the shell. The top and bottom surfaces taper toward each other at the sides and rear of the club, meeting at a rounded edge 18.

Figure 2:
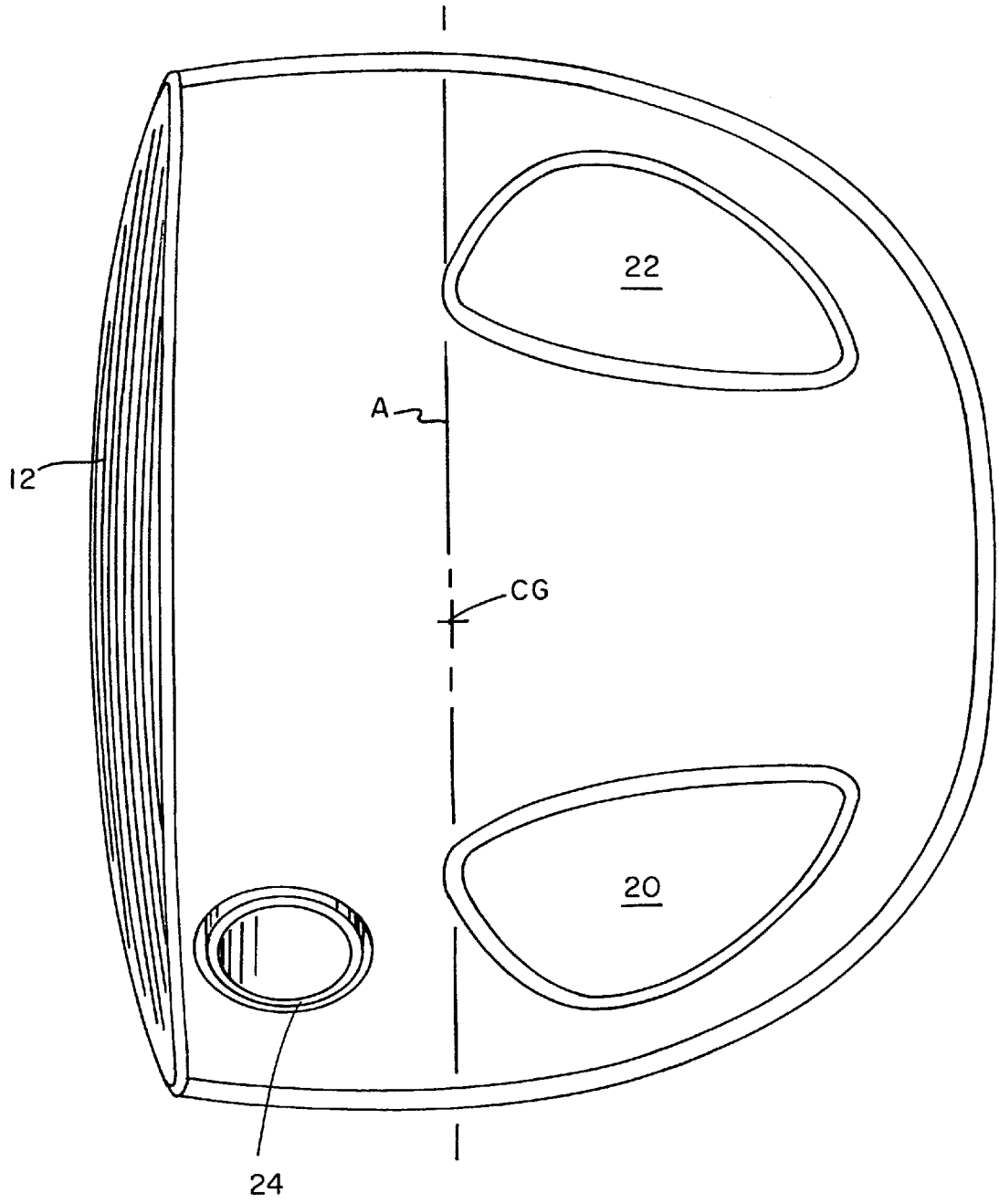
FIG. 2 is a top plan view thereof.

A pair of indentations 20, 22 are provided in the top surface (best seen in FIG. 2) for reasons not relating to this invention. Near the front left corner of the club head, a double-walled hosel 24 is seated in a hole in the top surface of the club. A portion of the club shaft "S" appears in FIG. 1 only.

Figure 3:
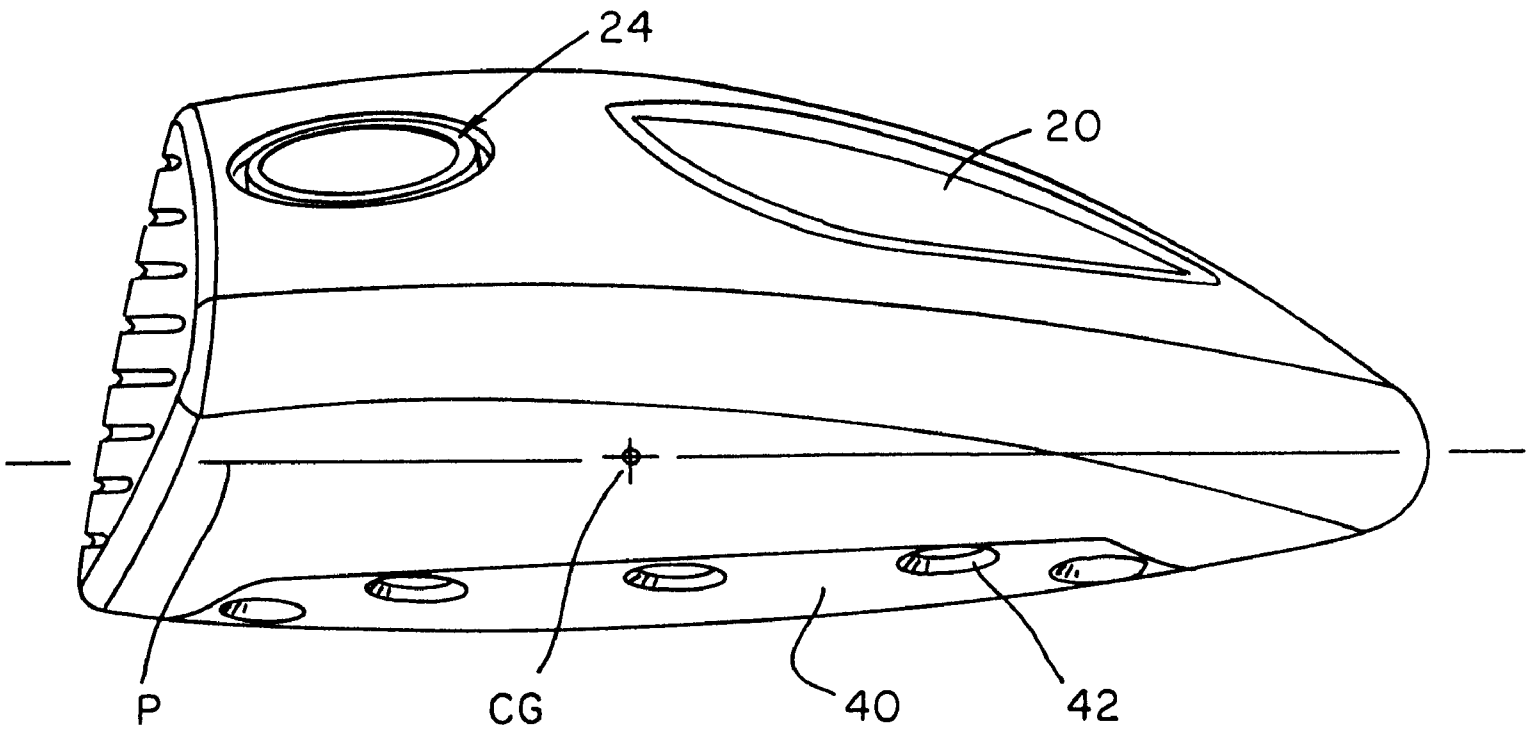
FIG. 3 is a left side elevation thereof.
Figure 4:
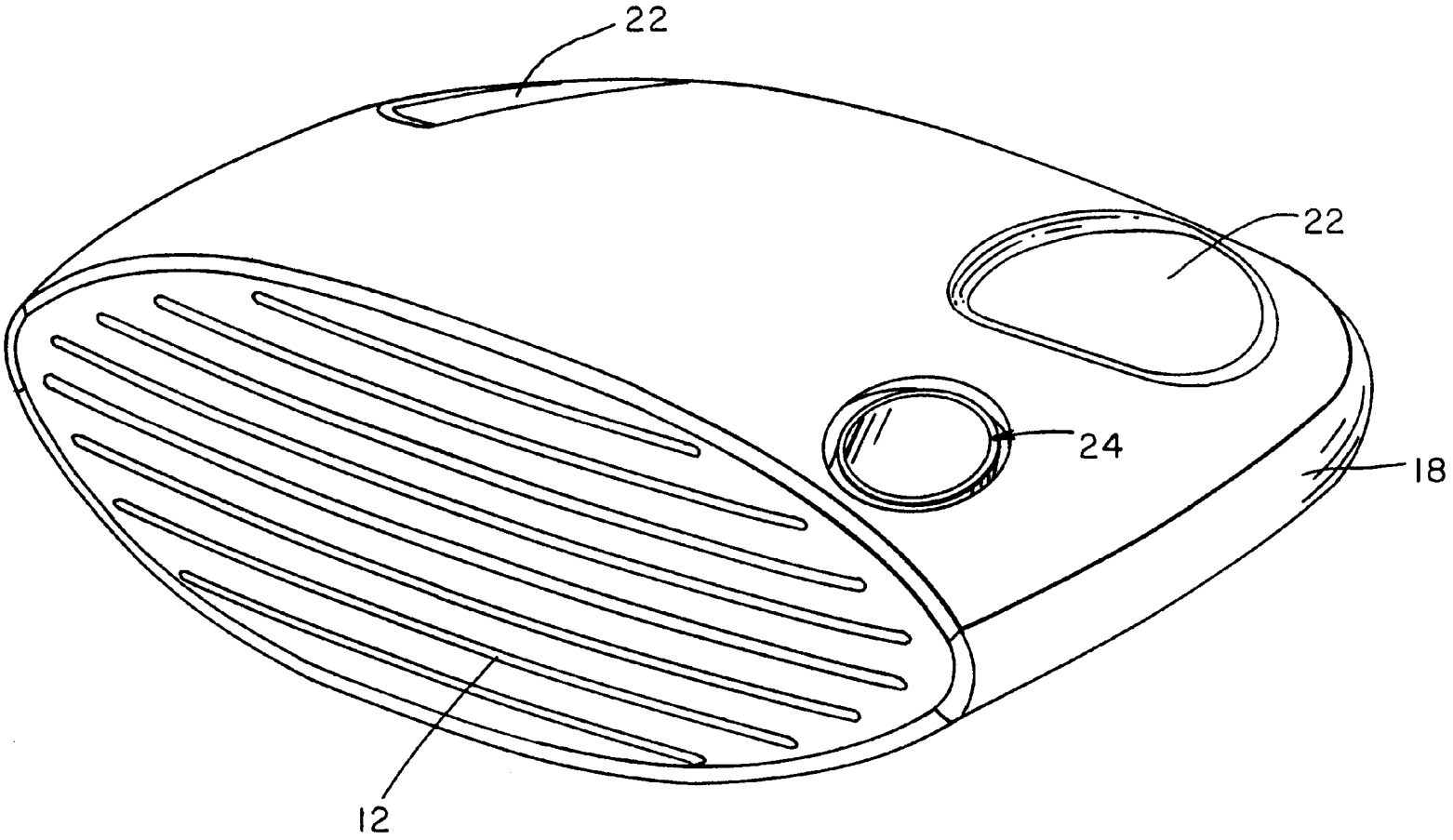
FIG. 4 is a perspective view thereof from above and in front.

The hosel comprises a smaller tube 26 within a larger tube 28, with substantial clearance therebetween forming an annular space. The tubes are interconnected below their midpoints by a bridge 30. Preferably, the bridge is at the very bottom of the outer tube, and slightly above the bottom of the inner tube. The bridge may be a weld bead, or it may be cast, extruded, or otherwise formed integrally with the tube material. The location of the bridge is preferably on or near a horizontal plane "P" (FIG. 3) containing the center of gravity "CG" of the club head, so that the inner tube, and the end of the shaft seated in it, do not experience substantial pitching torque. "Pitching" is used in the aeronautical sense to denote rotation about a horizontal axis perpendicular to the direction of club head motion. That axis is illustrated by the line "A" in FIG. 2. By reducing pitching, club head angle is maintained constant.

Preferably, the upper end of each tube is finished off flush with the top surface of the shell. This way, the hosel does not protrude at all from the club head, and does not contribute to aerodynamic drag on the head. We prefer to fill the annular space between the tubes with an elastomeric material 32 chosen for its damping properties so that it acts as a shock absorber to damp vibrations that may occur, and to further stabilize the hosel. The elastomeric material also distributes stress so that the entire load is not borne by the bridge.

Figure 5:
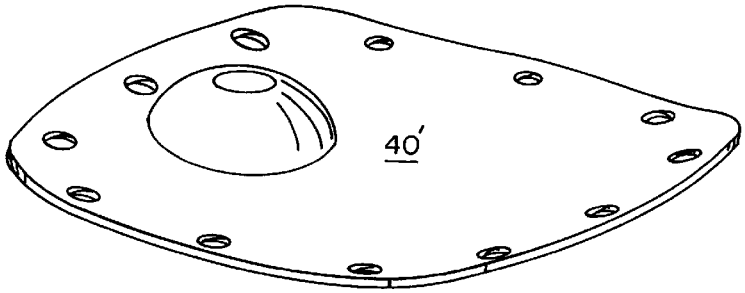
FIG. 5 shows an alternative interchangeable sole plate.

The sole plate 40 is removable. As one can see in FIG. 1, the sole plate has a number of peripheral countersunk holes 42 through which one inserts screws 44 that thread into tapped bosses 46 provided around the bottom opening of the shell. The sole plate is made of a metal substantially more dense than the shell material, to give the club a low center of gravity. The added eccentric weight 48 provided on the upper surface of the sole plate determines the sole plate's center of gravity, and consequently affects the center of gravity of the club head. To enable one to adjust the club's exact center of gravity, an assortment of sole plates may be made available. (One alternative sole plate 40' is illustrated in FIG. 5 to suggest the assortment.) The user can then, through trial and error, find the sole plate which produces the best feel and performance.

As an alternative to providing an assortment of sole plates, or to complement the assortment, the sole plate and head can be constructed so that the sole plate can be removed, and then rotated to a different position. For example, the sole plate could have two alternative positions 180° apart, or possible four positions 90° apart. As long as the sole plate is weighted eccentrically (off-center), one can change the center of gravity of the club by changing the orientation of the sole plate. With the screw-type sole plate mounting arrangement illustrated in the drawings, the sole plate can be reoriented by removing its securing screws, rotating the sole plate, and then reinstalling the screws.

Since the invention is subject to modifications and variations, it is intended that the foregoing description and the accompanying drawings shall be interpreted as only illustrative of the invention defined by the following claims.

We claim:

1. A golf driver head comprising a double-walled hosel, the hosel being contained wholly within the head and comprising an inner tube into which a club shaft may be inserted, and an outer tube situated around the inner tube and having a clearance defining an annular space between the inner tube and the outer tube, and a bridge extending across the annular space, interconnecting the inner tube and the outer tube.

2. The invention of claim 1, wherein the bridge is below both the midpoint of the inner tube and the midpoint of the outer tube.

3. The invention of claim 2, wherein the bridge is at the bottom of the outer tube.

4. The invention of claim 1, wherein the annular space is filled with a damping material.

5. The invention of claim 1, wherein the driver head is a hollow shell made of metal.

6. The invention of claim 1, wherein the bridge is substantially on a horizontal plane containing the center of gravity of the driver head.

7. The invention of claim 1, wherein the shell has a bottom opening and a sole plate is installed in the opening.

* * * * *